United States Patent [19]

Hölter

[11] 4,100,033

[45] Jul. 11, 1978

[54] EXTRACTION OF CHARGE GASES FROM COKE OVENS

[76] Inventor: Heinz Hölter, Beisenstrasse 39-41, Gladbeck, Fed. Rep. of Germany

[21] Appl. No.: 790,420

[22] Filed: Apr. 25, 1977

Related U.S. Application Data

[63] Continuation-in-part of Ser. No. 602,659, Aug. 7, 1975, abandoned.

[30] Foreign Application Priority Data

Aug. 21, 1974 [DE] Fed. Rep. of Germany ..... 2440016
Oct. 17, 1974 [DE] Fed. Rep. of Germany ..... 2449391
Apr. 23, 1975 [DE] Fed. Rep. of Germany ..... 2517968

[51] Int. Cl.[2] ..... C10B 27/04
[52] U.S. Cl. ..... 201/27; 202/263
[58] Field of Search ..... 202/262, 263, 227; 201/27; 110/31

[56] References Cited

U.S. PATENT DOCUMENTS

| | | | |
|---|---|---|---|
| 3,537,957 | 11/1970 | Wagner | 202/263 |
| 3,645,854 | 2/1972 | Calderon | 202/263 |
| 3,675,400 | 7/1972 | Kubsch | 202/263 |
| 3,676,305 | 7/1972 | Cremer | 202/263 |
| 3,697,381 | 10/1972 | Kemmetmueller | 202/263 |
| 3,767,536 | 10/1973 | Ikeda | 202/263 |
| 3,868,309 | 2/1975 | Sustarsic | 202/262 |

*Primary Examiner*—Hiram H. Bernstein
*Attorney, Agent, or Firm*—Berman, Aisenberg & Platt

[57] ABSTRACT

Gases formed on charging a coke oven are extracted, burned and washed. A gas-handling system, mounted on a machinery truck of the coke-oven plant, is used. An extractor unit of the system comprises an extractor conduit which is connected to an updraft pipe of a coke oven during charging of the oven. The gas-handling system specifically comprises a combustion chamber shaped and dimensioned to ensure a gas flow at a velocity which does not exceed 10 meters per second. The combustion chamber comprises a heat-retentative lining to ensure that the temperature within the chamber does not fall substantially below the ignition temperature of charge gases between successive charging operations.

14 Claims, 3 Drawing Figures

EXTRACTION OF CHARGE GASES FROM COKE OVENS

RELATED APPLICATION

This application is a continuation-in-part of copending application Ser. No. 602,659, filed Aug. 7th, 1975 and now abandoned.

BACKGROUND OF THE INVENTION

Conventionally, a coke-oven plant comprises a large number of coke ovens in the form of a battery. Along one side of the battery (commonly referred to as the machinery, or pusher side) coke-levelling and pressing equipment (to level coke in the coke ovens after loading, and to press coke from the ovens on completion of coking) travels. Along the other side of the battery (commonly referred to as the coke side) a coke truck (which collects coke as it is pressed from a coke oven and conveys it to a quenching station) travels.

In a system for handling coke-oven charge gases, the charge gases are withdrawn from the coke oven by extractor units which are mounted on a charge truck, such extractor units drawing off the charge gases from charge openings (while charging the coke oven) and delivering the gases to combustion and washing units. However, this method of withdrawing the charge gases has the disadvantage that fine particles of coal tend to be carried along with the gases. This results in rather significant ejecton of coal when a strong suction unit is used. Moreover, the combustion unit (arranged in succession with the extractor unit), while being designed to burn the charge gases, is not capable of satisfactorily handling coal particles. Consequently, operational faults are likely to occur if too many particles of coal are drawn into the system. Thus, where charge gas extractor units are associated with the charging truck, it is necessary to provide a separator burner in asociation with each suction port so that gas, which has been drawn from a corresponding charge opening, can be burnt.

In order to avoid the drawbacks associated with such conventional charge-gas extractor units, the charge gases are drawn through an updraft pipe of the coke oven, which is being charged, since updraft pipes are arranged in such a way as to minimize the likelihood of particles of coal being carried out of an associated oven chamber. The application of an intensive suction draft to the updraft pipe yields substantially better results than the formerly-conventional, less intensive evacuation by suction at an individual charge opening.

However, in the evacuation of charge gas through an updraft pipe, gas flow rates are necessarily very high and far in excess of the capacity of conventional combustion and washing units mounted on the charge truck. For this reason, where charge gases have been drawn off through updraft pipes, it is customary to introduce aspired gases into a main collector pipe (associated with the updraft pipes) and from which the gases flow to high capacity combustion and washing units. However, due to the unfavorable chemical composition of the charge gases, this has tended to cause undesirable incrustation and congestion in the collector pipe after a very short time.

The high flow rates of charge gas, drawn off through an updraft pipe during charging, have previously made it unfeasible to provide an extractor, combustion unit and washing system which is either adapted to be driven along the coke-oven ceiling or combined with the charging truck.

Commercial coke-oven chambers are normally 20-ton chambers, which typically produce in the range of from 200 to 400 and, in exceptional cases, up to 700 cubic meters per minute of charge gas. Smaller coke-oven chambers ordinarily yield charge gas at approximately the same or at a slightly lower rate, but the total volume is smaller. The ignition temperature of charge gas varies considerably with its composition, and the first fraction, i.e. that produced during the first, e.g., ten seconds, from any batch or charge often has poor ignition properties. Although ignition temperature, per se, is not generally measured, its effects are reflected in the temperature of the charge gas during its passage from the coke oven through a combustion chamber. Charge gas leaves a coke oven at a temperature in the approximate range of from 300° to 600° C; after ignition the corresponding range is from 1200° to 1400° C. Ignition requires a heat level; an electric spark, e.g., is inadequate for ignition.

As coke oven charge gas varies considerably in composition, the time required for complete burning at established temperatures varies likewise. The variation is, e.g., from about 0.3 to about 0.6 second; complete burning is assured over a period of one second at ignition temperature or above.

Each of, e.g., from 70 to 200 coke-oven chambers in a battery is recharged every 18 to 24 hours. There are from 4 to 8 charges made per hour depending on the number of chambers in a battery or plant. From each charge gas is produced for a period of from 3 to 5 minutes.

There are thus periods, which range in duration from 2.5 to 12 minutes, during which a combustion chamber is virtually free of any charge and during which it quickly cools to a temperature below that sufficient to ignite charge gases in the absence of supplementary heat, such as that provided by a separate burner.

SUMMARY OF THE INVENTION

One aspect of the invention provides, in a coke-oven plant comprising a battery of coke ovens and a truck arranged to travel either alongside the battery on the machinery side thereof (as shown in FIG. 2) or on top of the coke oven battery (as shown in FIG. 3), means for handling gases produced by the coke ovens and including a gas-handling system comprising extractor, combustion and washing units, wherein:

(i) the gas-handling system is mounted on the truck;

(ii) the extractor unit comprises an extractor conduit adapted to be connected to an updraft pipe of a selected coke oven during charging of the coke oven;

(iii) the combustion unit is shaped and dimensioned to ensure that the velocity of flow of charge gases in a combustion chamber of the unit does not exceed 10 meters per second; and (iv) walls of the combustion chamber are provided with or by a heat-storage lining which maintains (between successive charging operations) the combustion chamber at a temperature which is not significantly lower than the temperature of ignition of the charge gases.

The truck upon which the system is mounted is conveniently the truck which also carries levelling and/or coke-pressing equipment for the coke-oven battery. The system is optionally mounted for travelling along the roof of the plant and is thus not limited to the machinery side, which is preferred.

This invention makes is possible to burn large volumes of charge gas safely and completely. The combustion unit of the system is mounted on a truck; it is provided with a combustion chamber of a size required to ensure that the drawn-off charge gases are burnt at slow flow speeds. Ignition of the charge gases is guaranteed by providing the combustion chamber with a suitable heat-storage lining, which retains sufficient heat to maintain the combustion-chamber temperature between charges at a high enough level to ignite gas introduced in successive charges.

The combustion chamber is preferably provided with a supporting burner, and the system comprises a device to supply fresh air to the combustion chamber. The supporting burner ensures safe ignition even if the temperature of the heat-storage lining of the chamber should drop below the charge-gas ignition point, but the principal purpose of the burner is for start-up. The controlled fresh-air supply serves to ensure an adequate supply of oxygen necessary for the combustion process.

The extractor unit has a conduit which is preferably mounted for telescoping and/or pivotable movement relative to the truck upon which the system is mounted. Such a universally-movable conduit enables a single system to be used in conjunction with a wide variety of oven designs.

The conduit is preferably provided with a device for opening and closing a valve means (e.g. provided by a cover or lid) in the updraft pipe, such operations being performed by movement of the conduit relative to the updraft pipe. With the aid of such an opening and closing device, it is possible to achieve substantial simplification in the method of extracting, burning and washing the charge gases.

According to another aspect of the invention there is provided, in transportable means for extraction by suction and subsequent combustion and washing of gases arising from charging one of a battery of coke ovens, said means comprising suction, combustion and washing units, the improvement wherein:

(a) the suction unit is provided with a conduit whereby the unit may be connected, during charging of a selected coke oven, to the updraft pipe of the coke oven;

(b) the combustion unit comprises a large combustion chamber for burning the whole of the charge gas volume which has been aspired, the passage cross-section of said chamber being sufficiently large to ensure that the flow velocity of charge gases to be burned does not exceed 10 meters per second, the chamber walls being provided with a ceramic lining acting as a heat store to maintain the required ignition temperature between successive charging operations; and (c) the suction, combustion and washing units are mounted on a machinery truck travelling on top of the coke-oven battery or, preferably, alongside the coke-oven battery on the machinery side thereof.

According to a further aspect of the invention there is provided, in a method for handling gases arising from the operation of charging a coke oven and comprising the use of a gas extractor, combustion and washing system, the improvement wherein said system is mounted on a truck arranged to travel on top of a battery of coke ovens or, preferably, alongside a battery of coke ovens on the machinery side thereof, and the extractor unit comprises an extractor conduit which is connected to an updraft pipe of a coke oven during charging of the oven.

DETAILED DESCRIPTION OF THE INVENTION

Figure 1:
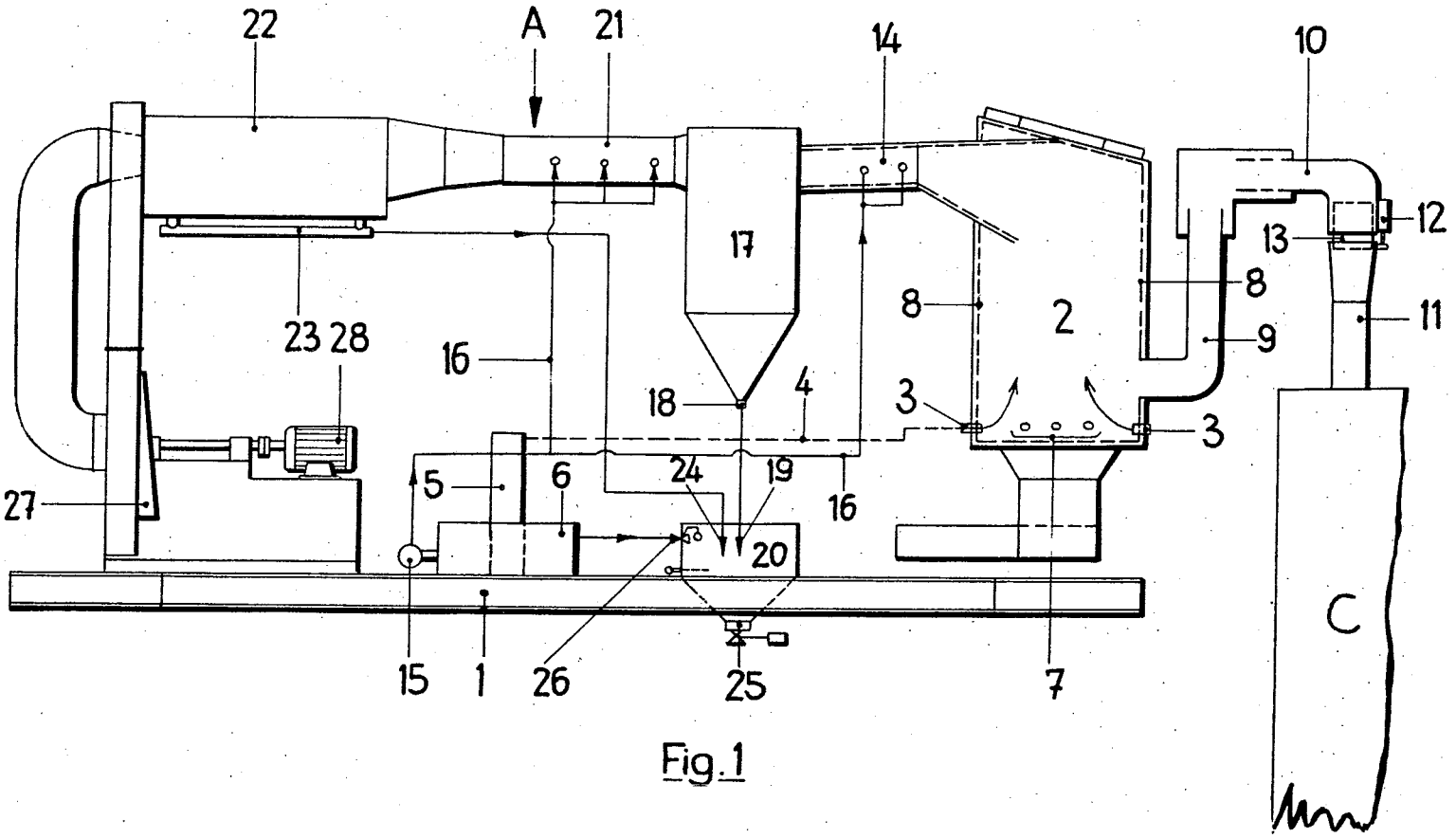
FIG. 1 illustrates a suction, combustion and washing system of means according to this invention.

In FIG. 1, the reference number 1 designates a supporting frame structure which carries a charge-gas handling system comprising extraction, combustion and washing units. The combustion unit comprises a combustion chamber 2 which is usually between 1 and 2 meters in diameter and between 2 and 4 meters in height. There are definite limits on the height or length of the combustion chamber. When it is too high, difficulties are encountered with obstructing cables, bridges, etc. The total height of the complete apparatus, including undercarriage, should not exceed eight meters and is preferably significantly less. The charge gases, which are drawn from a coke oven by the extractor unit, are burned in the combustion chamber 2, which comprises a supporting burner 3 supplied with gas from a gas tank 5 (which is cooled within a water tank 6) through a gas pipe 4. The combustion chamber 2 further comprises a fresh air supply means 7 by which fresh air is fed in a controlled manner to the chamber 2 so that sufficient oxygen is available for complete combustion. It is important to provide the combustion chamber with a fresh-air supply during burning, even if only by using a ventilator.

The combustion chamber 2 is provided with, e.g., 10 to 15 cm thick masonry lining 8 which withstands working temperatures up to 1600° C, which acts as a heat store and which remains sufficiently hot, i.e. at a temperature of from about 200° to about 1400° C, during intervals between two successive charging operations to ensure safe ignition. (The lining can be thicker, but a thicker lining reduces the internal working diameter and increases the lining cost without any appreciable benefit. If the lining is considerably thinner, it will not provide the required heat storage capacity between charges, the gas might not be ignited and the shell plate might be damaged or even melted.)

In the combustion chamber charge gas burns at about 1400° C. The inner wall temperature is in the approximate range of from 800° to 1000° C immediately after burning a gas charge and may decrease to from 200° to 300° C just prior to receiving a subsequent charge when the chamber handles four charges per hour or to about 500° C just prior to receiving a subsequent charge when the chamber handles eight charges per hour. These figures apply to combustion chambers varying from one to two meters in diameter. Temperature in the range between 200° and 300° C normally are sufficient for ignition of the charge gases.

In cases where the inner wall temperature decreases below this range, which may be due to low charging frequency or in cases where the charge gas is not freely ignited at a temperature within the range ignition takes place by the above mentioned supporting burner 3.

The cross section of the combustion chamber 2, having an inner diameter of, e.g., from about 1 to about 2 meters, is calculated to such size as to ensure (at a maximum charge-gas output) that the residence time in the combustion chamber is adequate and that the flow velocity through the chamber does not exceed 10 meters per second. This maximum flow velocity is critical and is essential to ensure complete combustion of the charge gases at all times.

Lining 8 is preferably installed by ramming or tamping according to well known and established procedures. The surface is finished by spraying. The steel casing of the combustion chamber has rods or anchors of heat-resistant steel welded or otherwise fixed to its inner side at about 5-centimeter intervals to hold lining 8 in place. The type of lining, its construction and its installation are known in the art and are not, per se, the invention to which this application is directed. A refractory lining which is less than about 10 centimeters in thickness is ordinarily inadequate to maintain combustion temperature in the combustion chamber between charges; one which is in excess of about 15 centimeters in thickness merely adds to the cost without serving any useful purpose.

A typical example of lining material is a material sold under the denomination, "Rapidoblock 5 RG17S", by Adoph A. Fleischmann of Frankfurt, Germany. This material is readily used at temperatures up to 1,670° C, pyrometric cone equivalent 37. It has a weight per unit of volume of 2.3 tons per cubic meter. By analysis, it comprises about 61% of $Al_2O_3$, about 32% of $SiO_2$ and about 0.8% of $Fe_2O_3$ (the percentages being by weight). It has a sintering temperature of 1,200° C and is sold in particulate form which varies in diameter from 0 to 25 mm. The material is inserted into the chamber by pouring or casting (not by ramming), and a shuttering is used for casting. After casting, the material sets by a hydraulic process and thereby obtains a certain solidity. The formed layer is sintered before use by heating it slowly to a temperature of 1200° C. Any suitable alternative refractory material is used and applied by casting, ramming or bricking, provided that the material withstands temperatures of at least 1600° C and has a high resistance to thermal shock or to spalling.

An inlet pipe 9 of the combustion chamber 2 is connected with an extractor conduit 10 in a manner which allows telescoping and pivotable movement of the latter relative to the former, the conduit 10 being adapted for connection to updraft pipe 11 of the coke-oven chamber which has just been charged. Charge gas passes into the apparatus via updraft pipe 11 of the coke-oven chamber or via an opening used for filling coal into the chamber. (The opening in the ceiling of the coke-oven chamber is not used for filling coal when coal is charged from the side. In this case the opening is a safety precaution in the event of an explosion in the chamber.) Valve means of updraft pipe 11, provided by a lid or cover 12 thereof, is shown open in FIG. 1. The end of extractor conduit 10 is further provided with an opening and closing device 13, whereby the cover 12 of the updraft pipe 11 may be opened or closed by appropriate movement of the conduit 10 relative to the updraft pipe.

The charge gases should be maintained in the combustion chamber for at least 0.5, and preferably a minimum of 0.75, second. A maximum residence time of from 2 to 3 seconds is generally more than adequate, but there is no technical upper limit other than that dictated by economical considerations. The residence time for complete burning of charge gas is influenced by the actual composition of the charge gas. Low-caloric-value gas requires a relatively long residence time, whereas high-caloric-value gas requires a measurably shorter residence time. A high proportion of very heavy hydrocarbons and, perhaps, coal dust requires a long residence time; light hydrocarbons require a shorter residence time.

A coke oven chamber which holds 21.2 tons of coal normally produces a maximum of from 300 to 400 cubic meters of charge gas per minute. This figure is typical for currently-employed coke oven chambers. 400 cubic meters per minute of charge gas require a chamber of at least 1.5 meters in diameter and 2 meters in height. This provides a residence time of 0.53 seconds. 300 cubic meters per minute of charge gas and a chamber of 2 meters in diameter and 4 meters in height result in a residence time of 2.52 seconds. Space, weight and price dictate the upper limits of combustion chamber dimensions.

When the volume of the combustion chamber is too small for a given quantity of charge gas per minute, a residence time of less than 0.5 second and/or a flow rate of more than 10 meters per second results. Under such conditions the charge gas does not burn completely; unburned hydrocarbons and tar clog the washer or even go into the atmosphere. [400 cubic meters per minute of charge gas require a length (or height) or more than 4 meters for a one-meter diameter chamber and 2 meters for a 1.5-meter diameter chamber for a residence time of at least 0.5 second; a chamber of 2 meters in diameter and 2 meters in length is sufficiently large to accommodate a gas flow of 700 cubic meters per minute and to allow for a minimum residence time of 0.5 second.] Although the length of the combustion chamber is an essential parameter for calculating residence time, the artisan knows the length of time required at combustion temperatures to achieve complete burning, as well as the volume of charge gas per minute his coke oven yields. He is thus readily able to calculate the diameter of a combustion chamber needed to obtain a gas speed of less than 10 meters per second. The length of such a combustion chamber is, likewise, immediately determinable. A knowledge of normal proportions of combustion chambers, which is well within the skill of the art, applied to the calculated diameter, as previously noted, results in combustion-chamber dimensions which automatically yield suitable residence times.

Basic figures concerning combustion chamber dimensions, charge rate and residence time are easily calculated and are reflected in Tables 1, 2 and 3.

TABLE 1

| COMBUSTION CHAMBER | | | |
|---|---|---|---|
| Diameter (meters) | 1.0 | 1.5 | 2.0 |
| Cross Section (square meters) | 0.79 | 1.77 | 3.14 |

TABLE 2

| | CHARGE GAS SPEED (meters per second) | | |
|---|---|---|---|
| Cubic meters per minute | Chamber Diameter (meters) | | |
| | 1.0 | 1.5 | 2.0 |
| 150 | 3.17 | 1.41 | 0.80 |
| 300 | 6.33 | 2.82 | 1.59 |
| 400 | 8.44 | 3.77 | 2.12 |

TABLE 2-continued

| Cubic meters per minute | CHARGE GAS SPEED (meters per second) Chamber Diameter (meters) | | |
|---|---|---|---|
| 700 | 14.77 | 6.59 | 3.72 |

TABLE 3

| Charge Gas (cubic meters per minute) | RESIDENCE TIME (seconds) 2-Meter High Chamber Diameter (meters) | | | 3-Meter High Chamber Diameter (meters) | | | 4-Meter High Chamber Diameter (meters) | | |
|---|---|---|---|---|---|---|---|---|---|
| | 1.0 | 1.5 | 2.0 | 1.0 | 1.5 | 2.0 | 1.0 | 1.5 | 2.0 |
| 150 | 0.64 | 1.42 | 2.52 | 0.94 | 2.14 | 3.78 | 1.26 | 2.84 | 5.04 |
| 300 | 0.32 | 0.71 | 1.26 | 0.47 | 1.07 | 1.89 | 0.63 | 1.42 | 2.52 |
| 400 | 0.24 | 0.53 | 0.94 | 0.36 | 0.80 | 1.42 | 0.47 | 1.06 | 1.89 |
| 700 | 0.14 | 0.30 | 0.54 | 0.20 | 0.46 | 0.81 | 0.27 | 0.61 | 1.08 |

The relevant parameters of chamber diameter, chamber length, charge gas velocity and residence time are interrelated, but they are not the only critical factors. Irrespective of how small a combustion chamber diameter is, sufficient residence time can be obtained by appropriate length. Even at gas speeds below 10 meters per second the chamber can be so long that it looks like a chimney or a gun barrel. This is extremely dangerous. Explosions, even rather heavy ones, are unavoidable in such combustion chambers. When a chamber has a chimney- or gun-barrel-shape or proportions, backstroke therein (while burning charge gas) may be strong enough to destroy the ceiling of the coke oven (when the apparatus rides above the coke oven) or understructure of the apparatus (when it rides at the machine side). The forward thrust of such an explosion, taking place in a long barrel, may destroy the washer, ventilator or other nearby equipment.

For combustion chambers having a diameter of from one to two meters, a ratio of height:diameter of up to 2.5:1 or even 3:1 is regarded as safe, but a ratio above 5:1 is considered dangerous.

From the combustion chamber 2 there extends a smokegas conditioning passage 14 of the washing unit, wherein the burned gas is cooled to a temperature of approximately 100° C. This is effected by spraying the gas with water which is drawn from the water tank 6 and spray-injected by a pump 15 through a water pipe 16 into the passage 14. Solid conditioning passage 14 extends to a preliminary sedimentation separator 17, the sludge outlet of which leads through a submerged immersion pipe 19 into a soiled-water tank 20.

From the preliminary separator 17 the partially-cleaned gas is conducted to a main washer 21 followed by a further separator 22. In the main washer 21 the fumes are again sprayed with water from the water pipe 16, and the sludge outlet 23 of the separator 22 is connected with the soiled water tank 20 likewise by means of a submerged immersion pipe 24. The soiled-water outflow 25 and the fresh-water inflow 26 of the tank 20 are controlled in such a way as to eliminate the need for the provision of a soiled-water pump which would be subject to a constant risk of congestion.

The pressure gradient needed for evacuation through the charge-gas handling system is produced by a fan 27 driven by an electric motor 28 and connected by a pipe to the separator 22.

Figure 2:
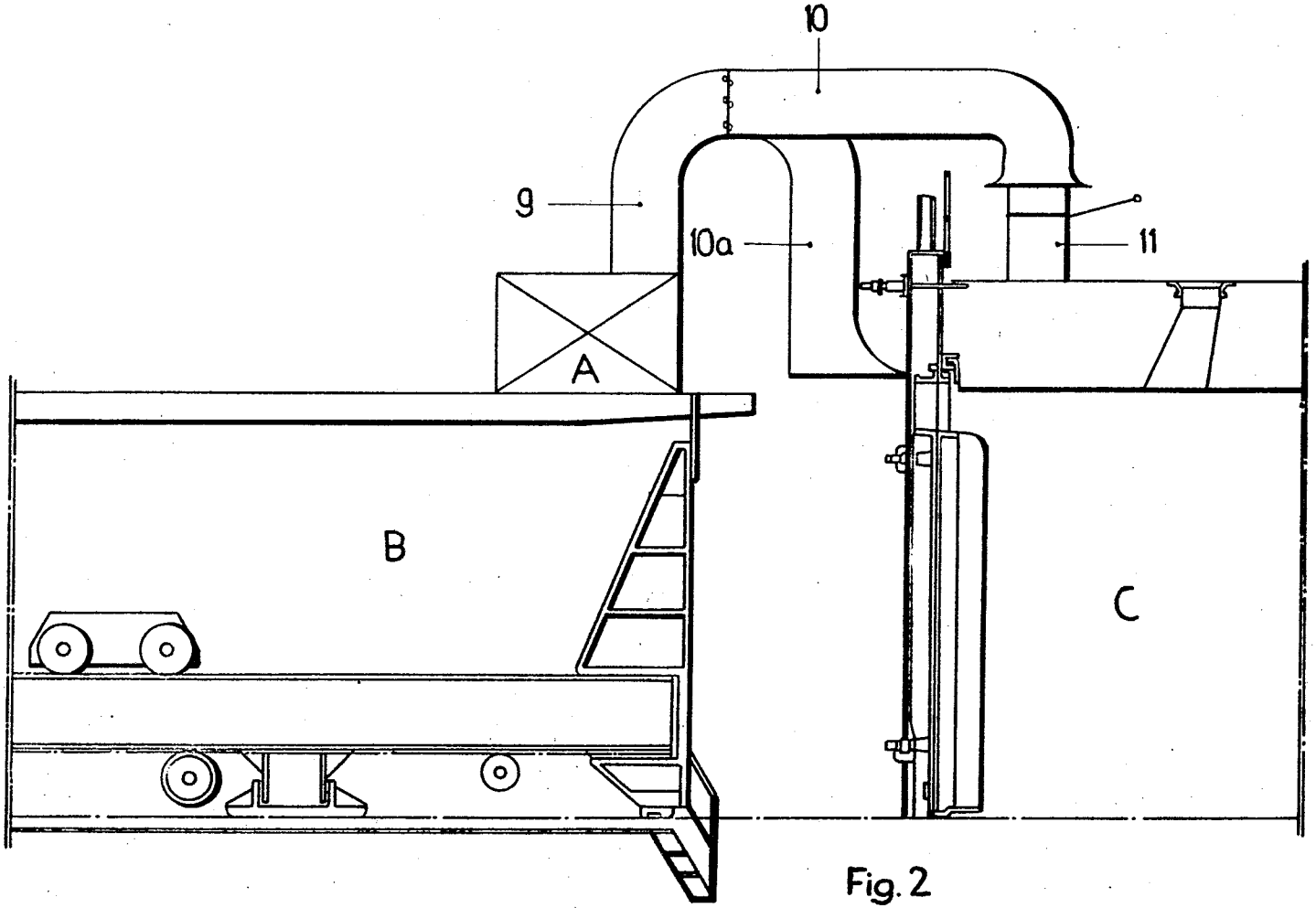
FIG. 2 illustrates the disposition of the system on a machinery truck which travels alongside of the coke-oven battery.

In FIG. 2, the charge-gas handling system is in the form of a box A. In FIG. 2 the entire system, symbolized by the box A, is arranged on the machinery truck B which is adapted to travel on the machinery side lengthwise of coke-oven battery C, alongside the individual coke ovens. According to this embodiment the roof of the coke-oven plant is totally relieved of the load of system A. Moreover, the soiled water or outflowing washing water cannot run over the roof of the coke oven.

In addition, the extractor conduit 10 is provided with a branch conduit 10*a*, whereby gases may be drawn off which emerge through the coke-oven door on the machinery side thereof while the machinery truck is carrying out an operation on the coke oven, for example a levelling operation, which may be carried out while conduit 10 is withdrawing charge gases from the coke oven, or a coke-pressing operation whereby coke is discharged from the coke-oven chamber.

Figure 3:
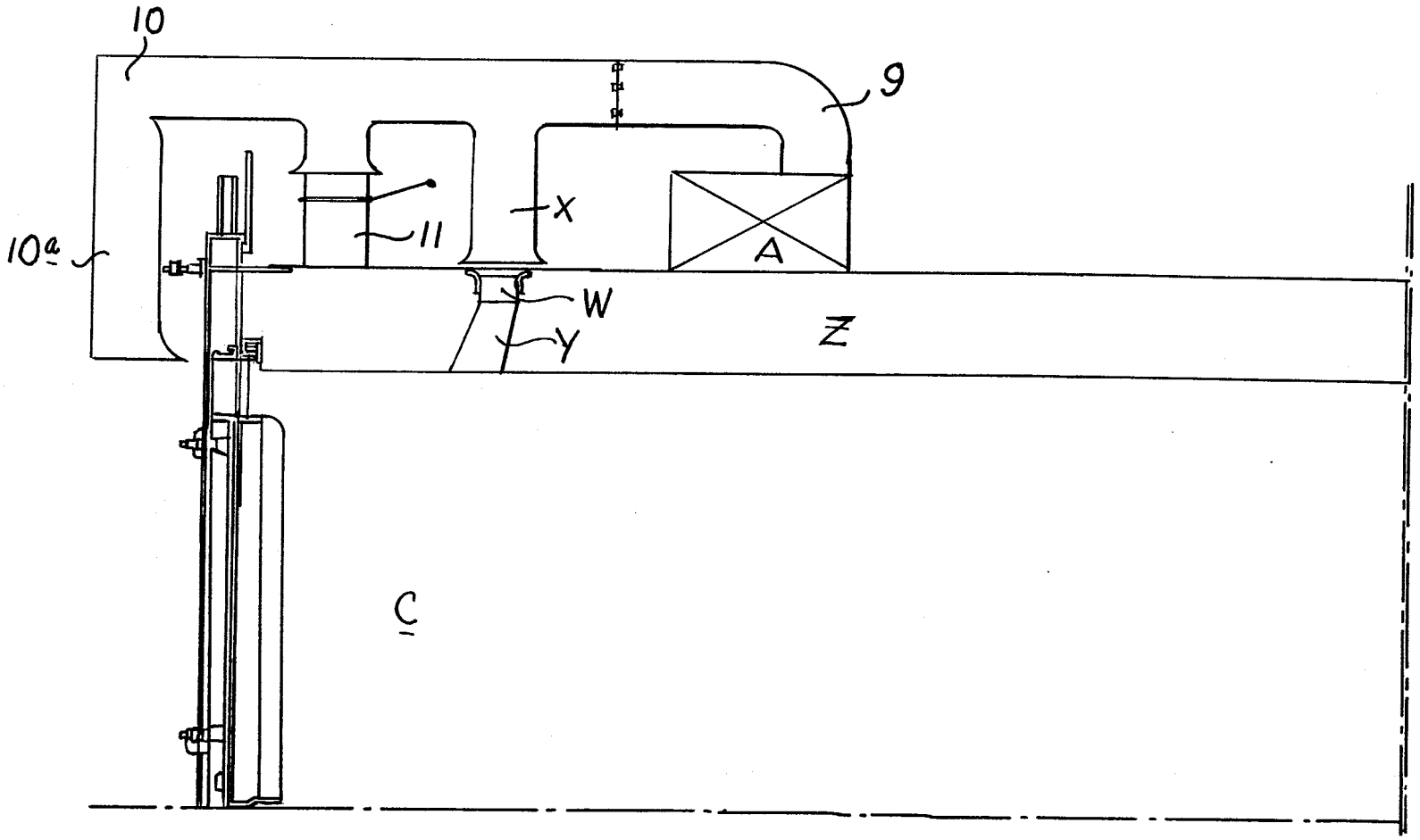
FIG. 3 illustrates the disposition of the system on a machinery truck which travels on top of the coke-oven battery.

FIG. 3 shows an optional alternative to the embodiment of FIG. 2. In FIG. 3 the charge-gas handling system (symbolized by box A) travels on the roof on ceiling Z of coke-oven battery C. Inlet pipe 9 is connected to updraft pipe 11 and, via pipe X, to opening Y in ceiling Z of the coke-oven chamber. (Opening Y is closed by lid W when it is not in use.) Inlet pipe 9 and extractor conduit 10 also go to branch conduit 10*a* for withdrawing charge gases from the coke-oven door.

Normally, gas is taken from 11, from 11 and 10*a* or from Y or from Y and 10*a*.

In order to obtain charge gas which burns well, sufficient gas-collecting space must be provided over coal in a coke-oven chamber; the chamber should not be filled to the top. When a preformed cake of coal is inserted into the chamber (the German word for this procedure is "Stampfbetrieb" or tamping method), the width of the cake should be a few millimeters less than the width of the chamber. The cake should not have too much contact with side walls of the coke-oven chamber.

The invention and its advantages are readily understood from the preceding description. It is apparent that various changes may be made without departing from the spirit and scope of the invention or sacrificing its material advantages. The actual embodiments hereinbefore described and illustrated are merely preferred embodiments and are not limitative of the invention other than where specifically so stated.

The accompanying copy of Leibrock, K., and Esche, M., "Cleaning of Charging Gas in Coking Plants using the Saarberg-Holter System", illustrates in the final one of the three contiguous color photographs at the end the nature of gaseous emissions when using the instantly-claimed invention as compared (in the center photograph) to what it replaced. The subject invention provides the only system existing in central Europe which is capable of making clear steam for more than three days, and this system has been making clear steam for a far longer period without interruption.

What is claimed is:

1. In a coke-oven plant comprising a battery of coke ovens and a gas-handling system for handling gases arising from coke-oven charges and comprising a combustion unit, the improvement wherein:

I. The gas handling system is mounted on a truck for movement lengthwise of the coke-oven battery;

II. The combustion unit comprises a combustion chamber which is shaped and dimensioned so that charge gases passing therethrough have a flow velocity which does not exceed 10 meters per second;

III. The combustion chamber has heat-storage lining means to maintain a temperature in the chamber between successive charges which is not significantly lower than charge-gas ignition temperature.

2. A coke-oven plant according to claim 1 wherein the truck is mounted for movement alongside the coke ovens on the machinery side thereof.

3. A coke-oven plant according to claim 1 comprising means to supply fresh air to the combustion chamber.

4. A coke-oven plant according to claim 3 wherein the means to supply fresh air is means to feed fresh air in a controlled manner so that sufficient oxygen is available for complete combustion of charge gases in the combustion chamber.

5. A coke-oven plant according to claim 1 wherein the gas-handling system comprises a washing unit, a passageway extending from the combustion unit to the washing unit, and the system comprising an extractor conduit adapted to be connected to an updraft pipe of a coke oven and which extends to the combustion unit.

6. A coke-oven plant according to claim 5 wherein said extractor conduit is provided with a device for opening and closing valve means of the updraft pipe.

7. A coke-oven plant according to claim 6 wherein the device operates to open and close said valve means responsive to movement of the extractor conduit relative to the updraft pipe.

8. A coke-oven plant according to claim 1 wherein the truck upon which the system is mounted is the truck which carries levelling and/or coke-pressing equipment.

9. A coke-oven plant according to claim 8 comprising extractor and washing units and an extractor conduit comprising a branch conduit to extract gases which emerge from a door of a coke oven during levelling or coke-pressing operations.

10. A coke-oven plant according to claim 9 wherein said extractor conduit is mounted for pivotal movement relative to the truck.

11. A coke-oven plant according to claim 10 wherein said extractor conduit is mounted for telescoping movement relative to the truck.

12. A coke-oven plant according to claim 1 wherein the combustion chamber is provided with a supporting burner.

13. In transportable means for extraction by suction and subsequent combustion and washing of gases arising from charging one of a battery of coke ovens, said means comprising suction, combustion and washing units, the improvement wherein:

(a) the suction unit is provided with a conduit whereby the unit may be connected, during charging of a selected coke oven, to an updraft pipe of the coke oven;

(b) the combustion unit comprises a large combustion chamber for burning all charge gas which has been aspired, the chamber having a cross-section which is sufficiently large to ensure a flow velocity of charge gases to be burned which does not exceed 10 meters per second, the chamber walls being provided with a ceramic lining which acts as a heat store to maintain a minimum required ignition temperature between successive charging operations; and (c) the suction, combustion and washing units are mounted on a machinery truck.

14. In a method for burning, in a combustion chamber, coke-oven gases produced in a battery of successive coke ovens, the improvement which comprises, in combination:

a. mounting the combustion chamber on a movable truck, b. passing gases from each of the successive coke ovens sequentially into said combustion chamber at a flow velocity which does not exceed 10 meters per second and for a period sufficient to burn the gases completely, and c. providing the combustion chamber with a refractory lining means to maintain a sufficient heat level between gas charges to ignite charges from successive coke ovens substantially without supplementary heating means.

* * * * *